US011131063B2

(12) United States Patent
Wright et al.

(10) Patent No.: US 11,131,063 B2
(45) Date of Patent: Sep. 28, 2021

(54) CARBON DIOXIDE SORBENTS AND STRUCTURES, METHODS OF USE, AND METHODS OF MAKING THEREOF

(71) Applicant: ARIZONA BOARD OF REGENTS ON BEHALF OF ARIZONA STATE UNIVERSITY, Scottsdale, AZ (US)

(72) Inventors: Allen Wright, Gilbert, AZ (US); Klaus Lackner, Paradise Valley, AZ (US)

(73) Assignee: Arizona Board of Regents on behalf of Arizona State University, Scottsdale, AZ (US)

( * ) Notice: Subject to any disclaimer, the term of this patent is extended or adjusted under 35 U.S.C. 154(b) by 0 days.

(21) Appl. No.: 16/927,775

(22) Filed: Jul. 13, 2020

(65) Prior Publication Data

US 2020/0340184 A1 Oct. 29, 2020

Related U.S. Application Data

(62) Division of application No. 15/565,363, filed as application No. PCT/US2016/026728 on Apr. 8, 2016, now Pat. No. 10,711,400.

(60) Provisional application No. 62/145,423, filed on Apr. 9, 2015.

(51) Int. Cl.

| | |
|---|---|
| ***D21H 17/63*** | (2006.01) |
| ***D21H 17/67*** | (2006.01) |
| ***D21H 27/00*** | (2006.01) |
| ***D21H 17/66*** | (2006.01) |

(52) U.S. Cl.

CPC ..... *D21H 17/63* (2013.01); *D21H 17/66* (2013.01); *D21H 17/675* (2013.01); *D21H 27/00* (2013.01)

(58) Field of Classification Search

USPC ..... 162/181.9

See application file for complete search history.

(56) References Cited

U.S. PATENT DOCUMENTS

| | | | | |
|---|---|---|---|---|
| 6,706,148 | B1 * | 3/2004 | Joisson | D21C 9/00 162/181.6 |
| 7,666,507 | B2 * | 2/2010 | Ishikawa | F02M 25/0854 428/408 |
| 8,840,706 | B1 * | 9/2014 | Srinivasachar | B01J 20/12 95/139 |
| 2009/0232861 | A1 * | 9/2009 | Wright | G06Q 30/018 424/405 |

* cited by examiner

*Primary Examiner* — Mark Halpern

(74) *Attorney, Agent, or Firm* — Rodney J. Fuller; Booth Udall Fuller, PLC

(57) ABSTRACT

Embodiments of the invention a method for producing a composite paper by providing a particulate sorbent, providing a paper pulp, and mixing the particulate sorbent and the paper pulp to develop a mixture. The method includes producing an article from the mixture that includes the particulate sorbent at least partially distributed through at least a portion of the article. Further, the at least one article is configured and arranged to uptake and release carbon dioxide as a function of moisture content. Some embodiments of the invention include a composite paper-like assembly including at least a first and second layer including hydrophobic fibers, and sorbent particles and/or a sorbent loaded paper sandwiched between the first and second porous sheets. Some further embodiments include a method for producing a material that supports a moisture swing by providing a material including activated carbon, and infusing the activated carbon with ionic salt.

13 Claims, 6 Drawing Sheets

CARBON DIOXIDE SORBENTS AND STRUCTURES, METHODS OF USE, AND METHODS OF MAKING THEREOF

RELATED APPLICATIONS

This application is a divisional of U.S. patent application Ser. No. 15/565,363, filed on Oct. 9, 2017 (published as 20180058008), which is the U.S. National Stage of International (PCT) Application No. PCT/US2016/026728, filed on Apr. 8, 2016, which claims priority from U.S. Provisional Application No. 62/145,423, filed on Apr. 9, 2015, the entire contents of which are incorporated herein by reference in their entireties.

BACKGROUND

Humidity or moisture swing sorbents are materials with affinity to carbon dioxide ($CO_2$) that can be modified substantially by the presence or absence of water. Conventional moisture swing sorbents bind $CO_2$ when relatively dry, and release them again when exposed to increased levels of moisture, either in the form of liquid water or water vapor. Some moisture swing sorbents can comprise polymers with quaternary ammonium ions attached to the polymer matrix and anions that are mobile in the polymer matrix. The material is active if large fractions of the anions are hydroxide, carbonate or bicarbonate ions. A typical conventional moisture swing sorbent is a strong-base anionic exchange resin. For specific resins studied in the past, the equilibrium partial pressure of $CO_2$ over the resin at room temperature can increase about five hundred fold as the humidity moves from 5 parts per thousand to fully saturated air (around 30 parts per thousand) or the resin is brought in contact with liquid water. In such systems, it is possible to capture carbon dioxide from ambient air (about 400 ppmV of $CO_2$ in the air) and release it at a partial pressure in the 1 to 10% range (1%=10,000 ppmV). It is possible to amplify the pressure boost by raising the temperature of the sorbent during regeneration. The moisture swing has been observed to release $CO_2$ from the sorbent in the bicarbonate until the material returns to what is effectively the "carbonate" state. The maximum possible size of the moisture swing is set by the concentration of positive ionic sites in the sorbent. For materials studied, the charge density is between two and three moles per kilogram. In the bicarbonate state the sorbent holds one $CO_2$ molecule for every positive charge, in the carbonate state it holds one $CO_2$ for every two positive charges. This is the practical size of the swing. This suggests that the $CO_2$ being released in a swing that is of the order of a few percent of the weight of the sorbent.

All well studied sorbents have in common that they are relatively brittle, glass-like materials that nevertheless swell significantly when exposed to moisture. The strains associated with swelling have so far made it impossible to create large structures from homogeneous sorbent material. This has prevented, for example, extruding simple monoliths or long thin strands of pure sorbent materials. On the other hand, fine powders can easily tolerate the strains and stresses associated with wetting and drying the sorbent. This in turn has resulted in composite materials in which sorbent powders are embedded into a matrix. For example, the Snowpure membranes (SnowPure, LLC, 130-A Calle Iglesia, San Clemente, Calif. 92672, USA) include resin particles that form about two thirds of the weight of the overall membrane. By packaging sorbent powders behind protective barriers, at least some air flow can permeate the barrier while protecting the sorbent from direct contact with salt water without stopping the exposure to moisture. Moreover, the effective use of a physical barrier can prevent chloride or sulfate ions (that may for example be present in salt water) to directly contact sorbent materials. The direct contact of salty water with a sorbent such as an ion exchange material can deactivate the material. During exposure to salty water, carbonate ions can be displaced with anions present in the salt, and the resin can cease to be a carbon dioxide sorbent. It is therefore a great advantage to have introduced a barrier to liquid water that prevents the exchange of ions. This type of barrier technology can make it possible to reduce the dependence on fresh water that until now was inherent in the humidity swing design.

SUMMARY

Some embodiments of the invention include a method for producing a composite paper comprising providing at least one particulate sorbent, providing a paper pulp, and at least partially mixing the at least one particulate sorbent and the paper pulp to develop a mixture. The method includes producing at least one article from the mixture, where the at least one article includes the at least one particulate sorbent at least partially distributed through at least a portion of the at least one article. Further, the at least one article is configured and arranged to uptake and release carbon dioxide as a function of moisture content.

In some embodiments, the at least one particulate sorbent comprises a carbon dioxide sorbent. In some embodiments, the at least one article exhibits a change in uptake and release of carbon dioxide based at least in part on exposure to liquid water. In some further embodiments, the at least one article exhibits a change in uptake and release of carbon dioxide based at least in part on exposure to water vapor or humidity.

In some embodiments of the invention, the at least one article comprises a sheet. In some embodiments, the at least one article includes at least one of a honey-comb like monolith, a tube, fibers, mesh, and felt-like material. In some embodiments, the at least one article includes at least one resin, the at least one resin originating from the paper pulp or the at least one particulate sorbent. In some embodiments, the at least one particulate sorbent comprises at least one carbonate or bicarbonate salt. In some embodiments, the carbonate or bicarbonate salt comprises at least one of a sodium and a potassium salt. In some other embodiments, the at least one particulate sorbent comprises activated carbon.

In some embodiments of the invention, the carbonate or bicarbonate salt is at least partially distributed, mixed, impregnated or infused into activated carbon. In some embodiments, the at least one particulate sorbent comprises activated carbon with embedded ions, wherein the ions are embedded in the activated carbon. In some further embodiments, the ions include at least one of hydroxide ions, carbonate ions, and bicarbonate ions.

Some embodiments of the invention include a composite paper-like assembly comprising at least a first and second layer including hydrophobic fibers, and sorbent particles and/or a sorbent loaded paper sandwiched between the first and second porous sheets. In some embodiments of the invention, the sorbent particles or sorbent loaded paper include activated carbon. In some embodiments, at least a portion of the activated carbon includes infused ions, the ions including at least one of hydroxide ions, carbonate ions, and bicarbonate ions. In some embodiments, the sorbent particles or sorbent loaded paper includes hydroxide, carbonate, and/or bicarbonate.

Some embodiments include a method for producing a material that supports a moisture swing by providing a material comprising at least one activated carbon, and infusing the at least one activated carbon with at least one ionic salt. In some embodiments, the at least one ionic salt comprises at least one carbonate or bicarbonate salt. In some further embodiments, the at least one carbonate or bicarbonate salt comprises at least one of a sodium and a potassium salt.

DETAILED DESCRIPTION

Figure 1:
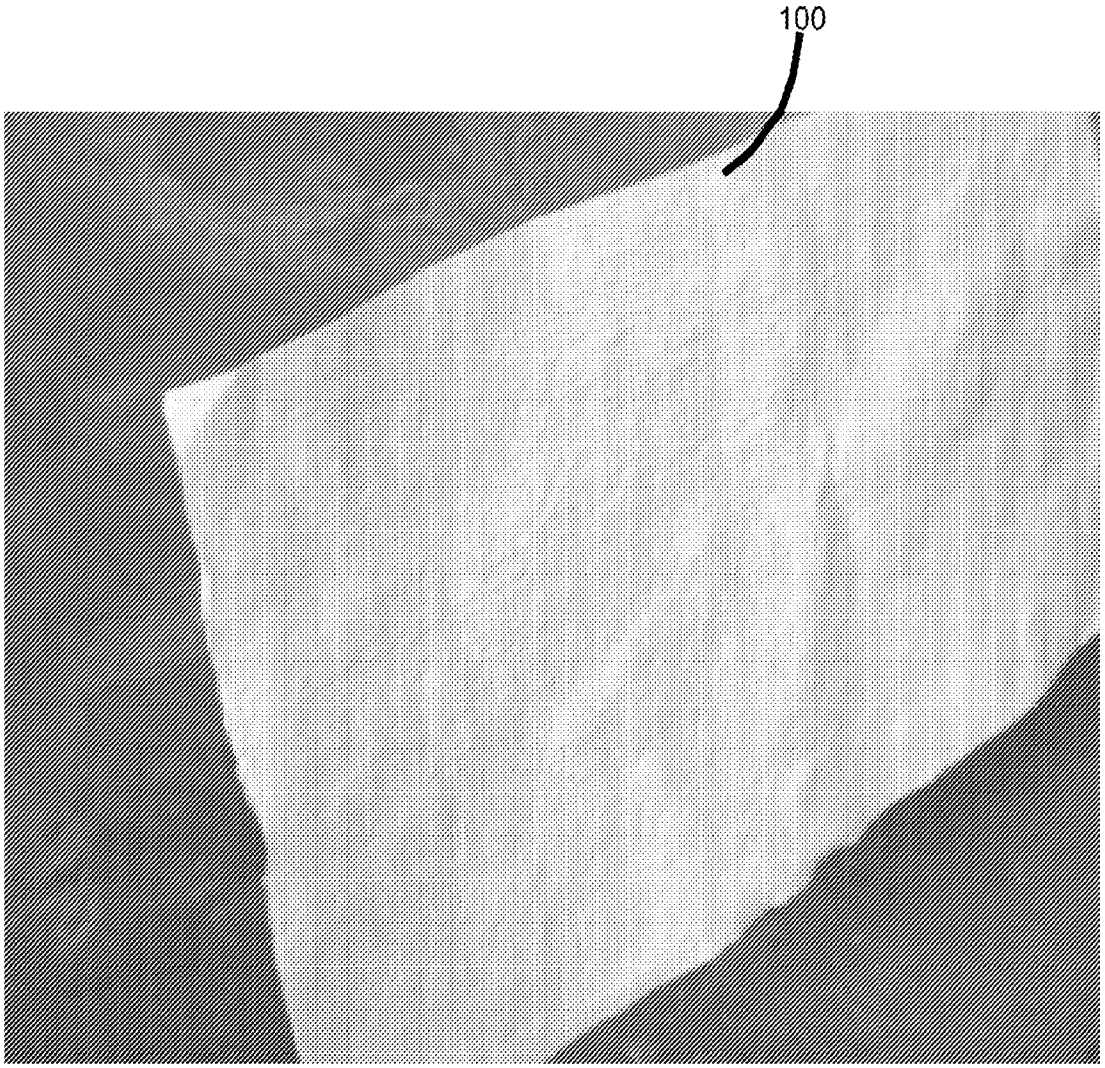
FIG. 1 shows an image of a moisture swing material in accordance with some embodiments of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives that fall within the scope of embodiments of the invention.

In the following description, the terms moisture swing and humidity swing are used nearly interchangeably, with a small difference in emphasis A moisture swing emphasizes the possibility that the water is brought in contact with the sorbent as a liquid, whereas the humidity swing is more focused on the case of water vapor getting in contact with the sorbent.

Some embodiments of the invention include methods and systems for producing carbon dioxide sorbents and structures. Embodiments of the invention extend beyond conventional air capture technology that uses "off-the-shelf" gas separation technologies extrapolated to extremely low carbon dioxide concentrations. Some embodiments include the use of humidity or moisture to induce the unloading of carbon dioxide from one or more sorbents that offer a distinctly different path to extracting carbon dioxide from air. Using one or more of the embodiments described herein offers an opportunity to separate a low concentration gas from a mixture that can include low carbon dioxide concentrations. Some embodiments include sorbents that exhibit a moisture swing when liquid water is brought in contact with the sorbent, whereas other embodiments include a humidity swing in the case of water vapor contacting the sorbent. Some embodiments include materials, composites or assemblies that exhibit a moisture swing and a humidity swing.

There are a number of different ways to create composite materials that contain a large amount of sorbent material embedded as small particles into a different material. The composite material in turn could be suitably shaped into a superstructure to produce efficient air filters that maximize the contact between sorbent and carbon dioxide in the air. Shapes that have been considered include, but are not limited to, the following: flat, sheets, honey-comb like monoliths, packages of thin tubes (akin to drinking straws), thin fibers forming meshes, or lose felt-like structures as seen in some glass-fiber furnace filters. The purpose of the secondary material is to hold the sorbent particles in place and allow them to change shape in the presence of water, while at the same time maximizing access of air to the resin particles. Until a sorbent material has been found that is either sufficiently elastic to absorb strains of the expansion in the presence of water, or that simply does not change volume in the presence of water, the strategy for making better materials involves composites.

Some embodiments of the invention include paper composites. In some embodiments, the use of a paper matrix can allow for very fine particles with rapid uptake, and with low mass. For example, various moisture swing sorbents can be ground finely and used as filler in making conventional paper materials. Some embodiments include the use of conventional papermaking techniques for producing humidity swing sorbents in the form of thin paper or paper mache structures. Paper can be generated rapidly and cheaply with sorbent powders attached to the paper structure, taking advantage of the cohesion between fibers and sorbent particles to attach very small particles to the fibrous structure of the paper. This concept can be extended from conventional paper fibers to any fibers to which sorbent particles stick. In the case of conventional paper fibers, the presence of hydroxyl groups on their surfaces help creating cohesion. By creating fresh pulp from spent sorbent paper, the valuable resin can be collected and separated from the fiber. Further, in some embodiments, additives such as sodium hydroxide (NaOH) can be used in this separation process. These techniques can also be extended to other paper like materials. In some embodiments, moisture can absorb on paper, and paper and resin particles adhere.

Figure 2:
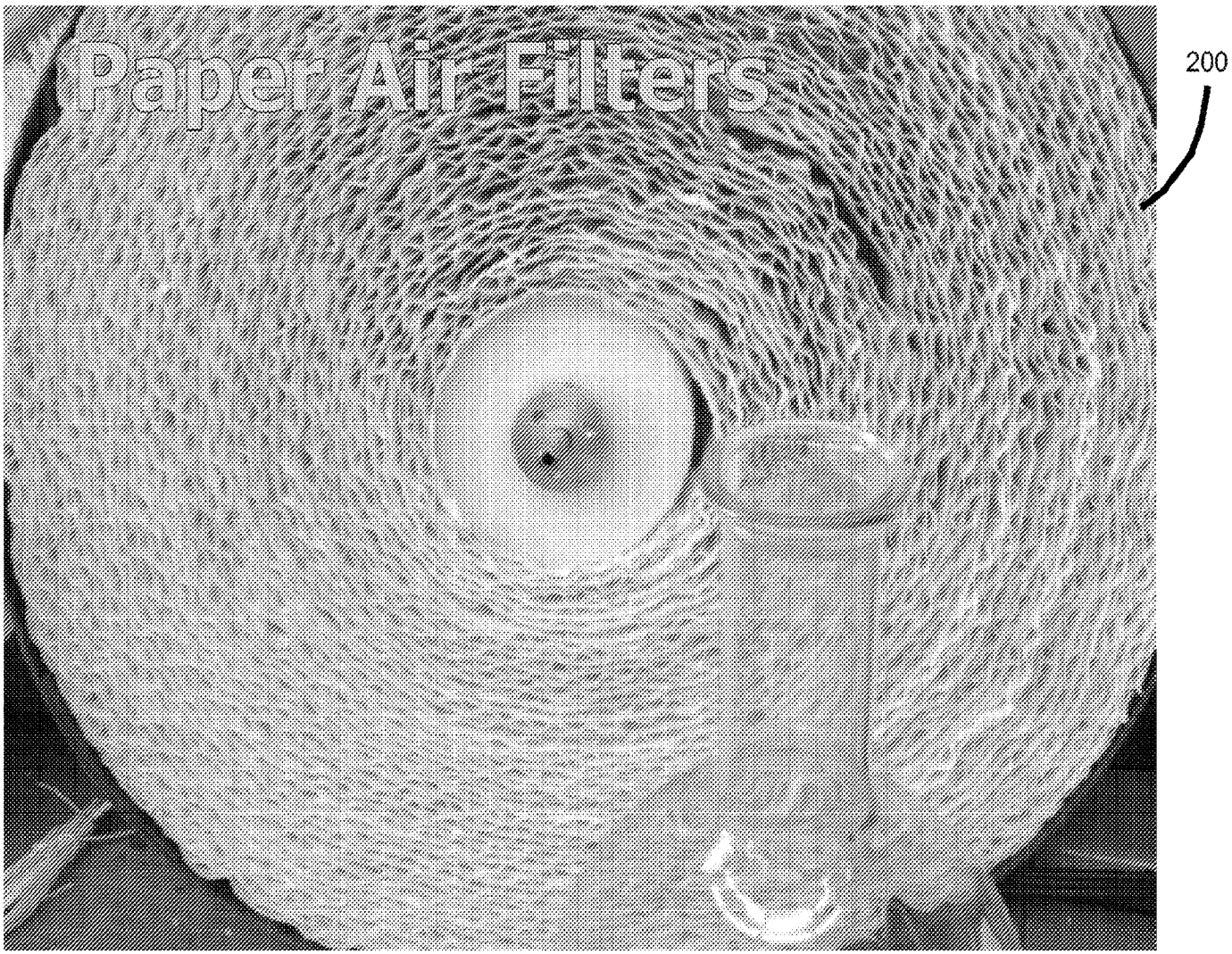
FIG. 2 shows an image of a moisture swing material formed as a filter in accordance with some embodiments of the invention.

FIG. 1 shows an image of a moisture swing material 100 in accordance with some embodiments of the invention. Further, FIG. 2 shows an image of a moisture swing material formed as a filter 200 in accordance with some embodiments of the invention. In some embodiments, conventional artisan paper kits can be used to produce sheets of paper made from paper pulp (i.e., paper pulp from paper). In some embodiments, by adding finely ground sorbent to paper pulp, flat sheets of active sorbent material can be fabricated that show high uptake rate and high release rates of carbon dioxide in a conventional humidity swing. In some embodiments, the materials include up to 50% by weight of sorbent material. Further, for a particular mass of adsorbent material, the performance can be significantly better than when compared with particles embedded in polypropylene (e.g., Snowpure-based membranes). The much smaller particle size in the paper material can contribute strongly to the enhanced performance. Furthermore, microscopic analysis can show the fibrous structure of paper is far more open than the pore structure in polypropylene (of the Snowpure membrane materials), and thus allows access of air to the sorbent particles with less hindrance. However, the hygroscopic nature of the paper leads to additional water absorption on the supporting structure that does not directly contribute to the moisture swing process.

Some embodiments of the invention includes methods and systems for producing carbon dioxide sorbents and structures including paper composites with sorbent powders attached to the paper structure, enclosed within the structure, or both. Some embodiments include composite materials that use highly hydrophobic but porous sheets to protect resin powders from direct contact with water. Each sheet can be a solid flat surface with small pores. Each sheet can be made from binding together a large number of matted fibers. In some embodiments, sorbents including resin powders can be embedded in small pouches between two plies of hydrophobic porous sheets. Further, in some embodiments, resin powders can be mixed with the fibers and held in place by a felt-like fibrous mat. In some further embodiments, a sheet-like sorbent can be created by mixing fibers and sorbent particles into a flat sheet that is bound together by heat treatment such as hot rolling. In some embodiments, the powder and fibers can be deposited onto the rollers so that the outside surfaces of the sheet contain minimal amount of sorbent. In this instance, the material or assembly can be a 3-ply structure with hydrophobic fibers on the top and bottom and sorbent particles in the middle, e.g., two hydrophobic porous sheets sandwiching a sorbent loaded paper on the inside. In some embodiments, the resin can be held in place by hydrophilic fibers (e.g. paper fibers) that prevent particles from drifting through the hydrophobic matrix.

Some embodiments include the use of commercial composites including Tyvek® brand composites comprising highly hydrophobic and porous sheets that protect embedded or enclosed sorbents (e.g., including resin powders and/or activated carbon with carbonate ions embedded into the carbon structure) from direct contact with water. Tyvek® is a registered trademark of DuPont Corporation. At atmospheric pressures, water cannot pass through an enclosure comprising a polyolefin fiber material because capillary forces can prevent water from passing into and through the pores of the material. However, at sufficient pressure, the capillary forces can be overcome and can push water or brine successfully through the material. Some embodiments include a method for removing contamination from the sorbent by driving brines rich in carbonate, bicarbonate or hydroxide ions, through the hydrophobic barrier by high pressure flows. It is therefore possible to regenerate a sorbent material that has been exposed to other ions and thus has become deactivated as a carbon dioxide sorbent. For example, it is possible for the sorbent to remove $SO_2$ and $NO_x$ from the atmosphere thereby reducing its carbon dioxide capacity. By forcing carbonate brine through the polyolefin material, it is possible to regenerate an enclosed sorbent by "washing out" the contaminating ions without the need to rupture or otherwise physically damage the surface of the enclosure.

Tyvek® comprises a polyolefin fiber material formed or converted into a paper-like material. In some embodiments, Tyvek® materials, Tyvek®-based materials, or Tyvek®-like materials can be used to form an enclosure and/or at least a partially sealed packet of sorbent material (hereinafter called an "assembly"). Some embodiments of the invention include composite paper-like materials having fibrous but extremely hydrophobic materials like Tyvek®. In order to enable matted fibers that stick to each other and bind into a strong paper like material, polyolefin fibers can be pressed together using heat (e.g., hot rollers) that result in a surface melting and binding together the overall matrix. The properties, features, or characteristics of Tyvek® useful for some embodiments of the invention include (1) it can be spun into very fine fibers, (2) the fibers are highly hydrophobic, and (3) there is a known defined temperature at which the fibers pressed together will stick to each other.

In some embodiments, a Tyvek® sheet can be separated into two plies, each one having one of the smooth surfaces outside, and the interior being less well bound. The material can be heated at or near the surface resulting in a flat tightly bound fibrous mat. On the inside of the material, the number of contact points between fibers is lower that at or near the outer surface, and the material appears "fuzzy." Using the materials as described above, enclosures or pouches can be formed into which sorbent material can be enclosed and at least partially sealed.

Figure 3:
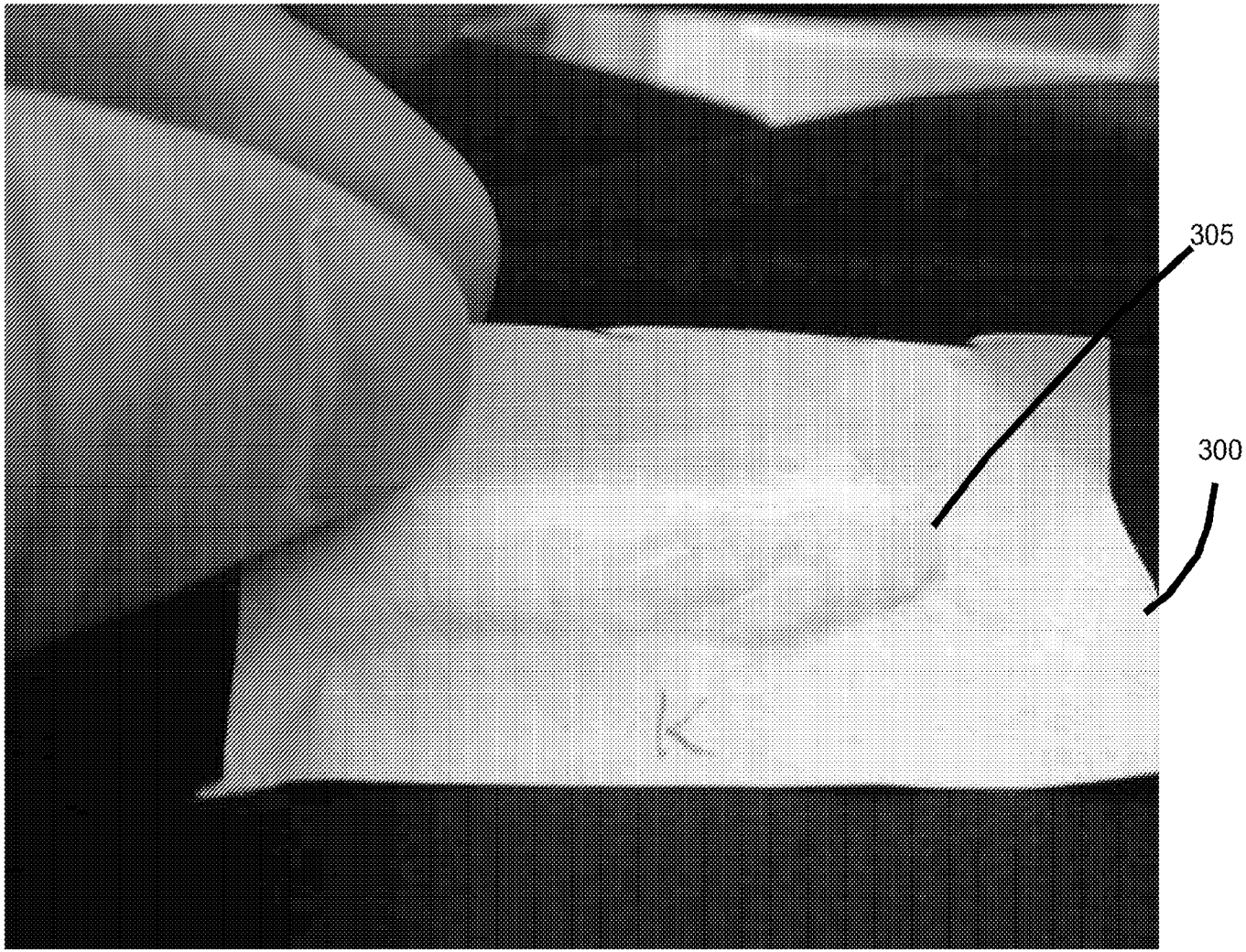
FIG. 3 shows an image of a moisture swing assembly in accordance with some embodiments of the invention.

In some other embodiments, equivalent materials can be used in place of, or in addition to the Tyvek® material. In some embodiments, the enclosure or pouch can comprise felt-like paper structures. In some embodiment, the enclosure or pouch material can be highly hydrophobic. In some embodiments, the enclosure or pouch material can comprise porous or semi-porous sheets. In some embodiments, the enclosure or pouch material can protect one or more enclosed sorbent materials from wind, water, contamination, or a combination thereof. In some embodiments, the enclosure or pouch can prevent one or more enclosed sorbents (e.g., such as sorbents in powdered form) from blowing away or otherwise being distributed or physically disturbed. Moreover, the enclosure or pouch can keep liquid water away from sorbent while at the same time, allowing water vapor to pass through the enclosure or pouch material. In this instance, the transfer from liquid water to the enclosed sorbent is fast, and heat transfer occurs over fractions of a millimeter. For example, FIG. 3 shows an image of a moisture swing assembly 300 in accordance with some embodiments of the invention. In some embodiments, the moisture swing assembly 300 can comprise an upper and a lower layer enclosing an embedded material 305. The embedded material 305 can comprise at least one sorbent material. In some embodiments, the upper portion of the enclosed can comprise a single piece of Tyvek® or Tyvek®- type material or can be composed of at least two or more layers or sections of Tyvek® material coupled together at selected regions.

In some embodiments of the invention, the enclosure or pouch material can comprise one or more polymer fibers. For example, some embodiments include polyolefin fibers. In some embodiments, the enclosure or pouch can include spun, non-woven fiber material (e.g., such as Tyvek®). Further, in some embodiments, the enclosure or pouch material can comprise thermally welded fibers of high density polyethylene (HDPE). In other embodiments, the enclosure or pouch can comprise spun, non-woven fiber material, and/or thermally welded fibers of polypropylene. In some further embodiments, the enclosure or pouch can comprise other polymers, including, but not limited to any conventional porous three-dimensional non-woven polymer matrices. In some other embodiments, the enclosure or pouch can comprise porous woven polymer matrices comprising polymer fibers and/or non-fiber particles.

In some embodiments, the sorbent can comprise an activated carbon. Some embodiments comprise a carbonate brine. Some embodiments include carbon impregnated with carbonate.

Figure 4:
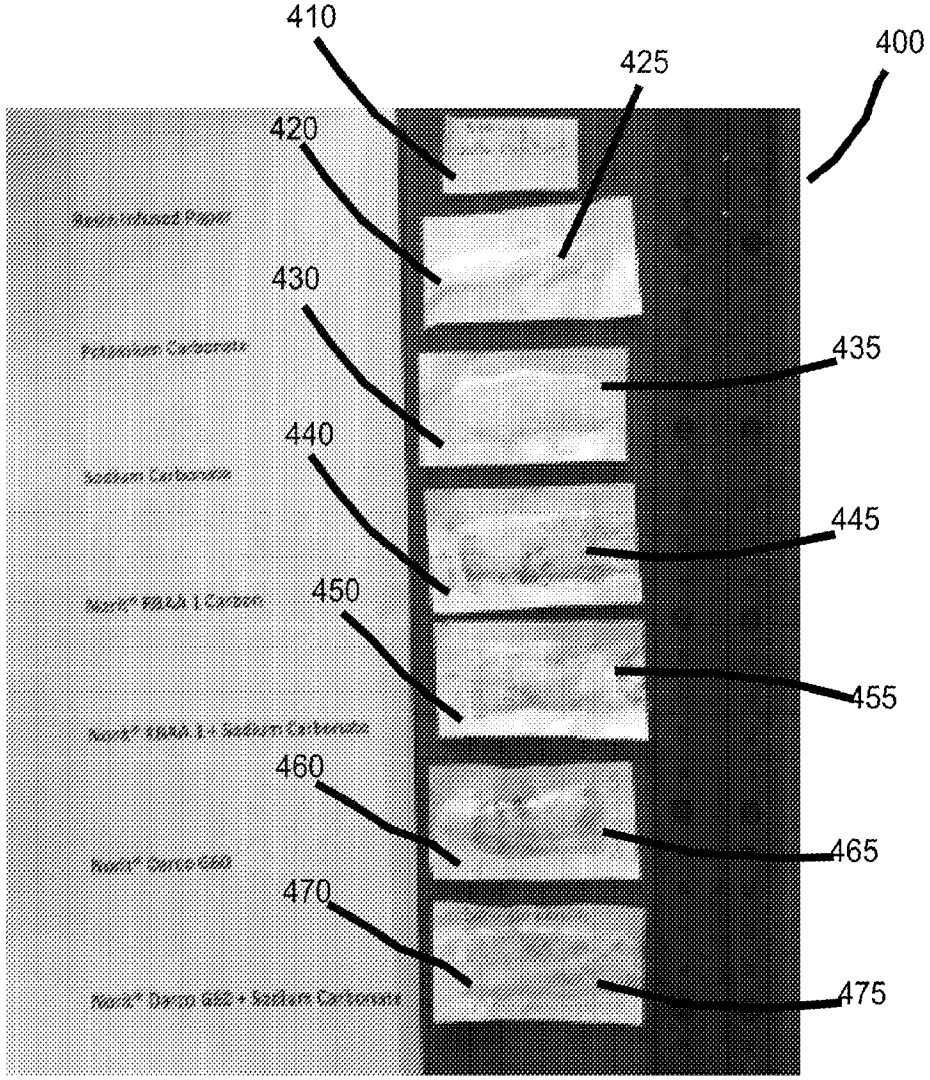
FIG. 4 shows an image of a plurality of moisture swing assemblies in accordance with some embodiments of the invention.

FIG. 4 shows an image of a plurality of moisture swing assemblies 400 in accordance with some embodiments of the invention. A single sheet of sorbent material 410 is shown comprising resin infused paper. In comparison, some embodiments include assembly 420 including embedded material 425 comprising potassium carbonate. In some further embodiments, assembly 430 includes embedded material 435 comprising sodium carbonate.

In some other embodiments, assembly 440 includes embedded material 445 comprising an activated carbon such as Norit® RBAA 1. In other embodiments, Darco® G60 can be used. For example, in some embodiments, assembly 460 includes embedded material 465. Darco® is a registered trademark of Norit Americas, Inc. Some further embodiments include Norit® activated carbon. Norit® is a registered trademark of Norit N.V.

Some embodiments include materials and assemblies with humidity swing processes with activated carbon with carbonate ions embedded into the carbon structure. Some embodiments include using hydroxide, carbonate, or bicarbonate solutions to impregnate activated carbon with salts that promote a humidity swing. Some embodiments include using the humidity swing for feeding carbon dioxide to photosynthesizing organisms by releasing carbon dioxide capture from ambient air and enriching it by a factor 2 to 20. Some embodiments include using the humidity swing with ion impregnated activated carbon for feeding carbon dioxide to photosynthesizing organisms. For example, using these materials, and releasing carbon dioxide capture from ambient air and maintaining a carbon dioxide level in an enclosure against the removal of carbon dioxide by a living organism, with the level ranging from below ambient to the maximum level achievable by the sorbent (at present up to 20 times higher). For example, in some embodiments, enclosure or pouches can include a sorbent that can comprise a carbonate and activated carbon combination, such as a mixture or composite of activated carbon and carbonate. Some embodiments include infusing activated carbon with potassium or sodium carbonate to produce a material that supports a moisture swing. Within the enclosures, individual materials of activated carbon, sodium carbonate and potassium carbonate can absorb carbon dioxide but show no moisture swing behavior. However, activated carbon infused with potassium (or sodium) carbonate does show a pronounced moisture swing. For example, in some further embodiments, assembly 450 includes embedded material 455 comprising an activated carbon such as Norit® RBAA 1 and sodium carbonate. In some further embodiments, assembly 470 includes embedded material 475 comprising an activated carbon such as Darco® G60 and sodium carbonate. In some embodiments, the enclosues or pouches can include more than one type of activated carbon and/or more than one carbonate. For example, some embodiments include mixtures of sodium and potassium carbonates. In other embodiments, other carbonates can be including, either alone or within mixtures of other carbonates and/or with one or more activated carbon materials.

In some embodiments, any of the enclosures or pouches described earlier can be subjected to a humidity swing depending on the exposed atmosphere. When using an enclosure comprising a polyolefin sheet, the enclosure is impermeable to liquid water, while being open to water vapor transmission. As a result, the enclosures or pouches can provide a complete humidity swing, with minimal obstruction from the surface that covers them. Since liquid water does not penetrate through the surface of the enclosure, the humidity swing can be induced by exposing the outside surface to salty or similarly contaminated water. The presence of the water can induce water vapor to cross the barrier, and thus cause a humidity swing within the enclosed sorbent. In some embodiments comprising a polyolefin barrier material, the material does not wet, and does not adsorb any water. Therefore, exposing the sorbent protected by a polyolefin porous barrier to water results in a controlled and minimum uptake of water. In some embodiments, an air capture system based on this concept can minimize its water consumption to what is necessary to drive the humidity swing.

Figure 5:
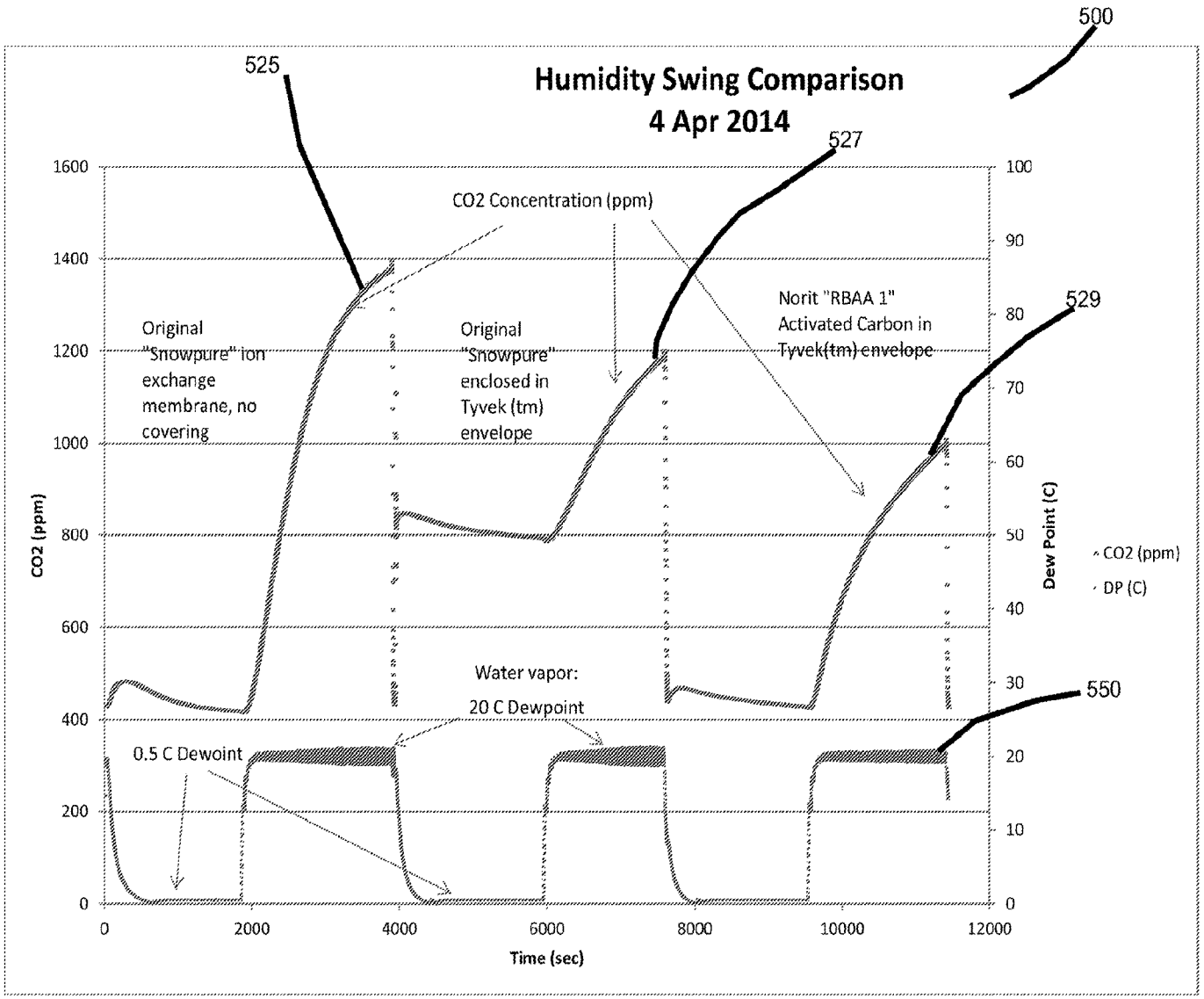
FIG. 5 illustrates a humidity swing comparison plot in accordance with some embodiments of the invention.
Figure 6:
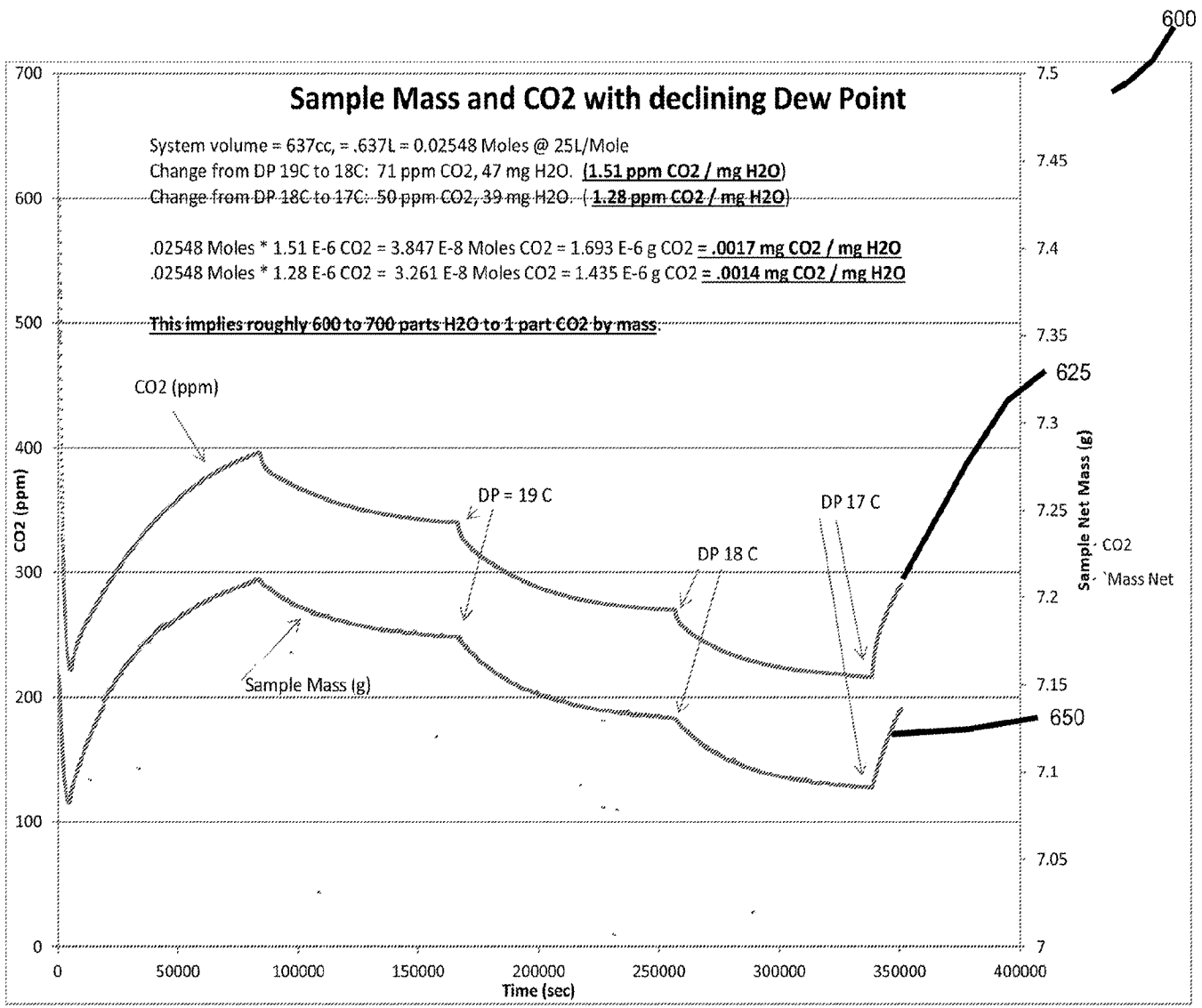
FIG. 6 shows a plot of sample mass and $CO_2$ as a function of dew point in accordance with some embodiments of the invention.

FIG. 5 shows a humidity swing comparison plot 500 with a comparison of an ion exchange membrane (Snowpure), a snowpure membrane enclosed in a Tyvek® enclosure, and assembly 440 including embedded material 445 comprising an activated carbon such as Norit® RBAA 1 in accordance with some embodiments of the invention. For example, data lines 525, 527, 529 show $CO_2$ concentration as a function of time for Snowpure ion exchange membrane (with no enclosure), Snowpure ion exchange membrane enclosed in Tyvek®, and Norit RBAA 1 activated carbon in a Tyvek® enclosure. Data line 550 shows the corresponding dew point (show contiguously for each of the corresponding data lines 525, 527, 529). FIG. 6 shows a plot of sample mass and $CO_2$ as a function of dew point in accordance with some embodiments of the invention, where data line 625 represents $CO_2$ concentration, and data line 650 shows the corresponding sample mass as a function of time.

Any of the embodiments disclosed herein can offer advantages of conventional technologies, including, but not limited to: can be used in advanced air capture technologies; can allow the production of granular $CO_2$ sorbents; can be regenerated with contaminated water; can be regenerated with salty water; and are less expensive and safer materials for sorbents; offer protection of sorbent from contaminants; and can offer water vapor transparent which protects sorbent from liquid water.

Although the invention has been described and illustrated with respect to exemplary embodiments thereof, it should be understood by those skilled in the art that the foregoing and various other changes, omissions and additions may be made therein and thereto, without parting from the spirit and scope of the present invention. Accordingly, other embodiments are within the scope of the following various embodiments. It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. Various features and advantages of the invention are set forth in the following claims.

The invention claimed is:

1. A method for producing a composite paper comprising:

providing at least one particulate sorbent;

providing a paper pulp;

at least partially mixing the at least one particulate sorbent and the paper pulp to develop a mixture; and producing at least one article from the mixture, the at least one article including the at least one particulate sorbent at least partially distributed through at least a portion of the at least one article; and wherein the at least one article is configured and arranged to uptake and release carbon dioxide as a function of moisture content.

2. The method of claim 1, wherein the at least one particulate sorbent comprises a carbon dioxide sorbent.

3. The method of claim 1, wherein the at least one article is configured to change in uptake and release of carbon dioxide in response to exposure to liquid water.

4. The method of claim 1, wherein the at least one article is configured to change in uptake and release of carbon dioxide in response to exposure to water vapor or humidity.

5. The method of claim 1, wherein the at least one article comprises a sheet.

6. The method of claim 1, wherein the at least one article includes at least one of a honey-comb like monolith, a tube, fibers, mesh, and felt-like material.

7. The method of claim 1, wherein the at least one article includes at least one resin, the at least one resin originating from the paper pulp or the at least one particulate sorbent.

8. The method of claim 1, wherein the at least one particulate sorbent comprises at least one carbonate or bicarbonate salt.

9. The method of claim 8, wherein the carbonate or bicarbonate salt comprises at least one of a sodium and a potassium salt.

10. The method of claim 9, wherein the carbonate or bicarbonate salt is at least partially distributed, mixed, impregnated or infused into activated carbon.

11. The method of claim 1, wherein the at least one particulate sorbent comprises activated carbon.

12. The method of claim 1, wherein the at least one particulate sorbent comprises activated carbon with embedded ions, wherein the ions are embedded in the activated carbon.

13. The method of claim 12, wherein the ions include at least one of hydroxide ions, carbonate ions, and bicarbonate ions.

* * * * *